US008703672B2

(12) United States Patent
Tipton et al.

(10) Patent No.: US 8,703,672 B2
(45) Date of Patent: Apr. 22, 2014

(54) HIGHLY BRANCHED SULFONATES FOR DRIVE-LINE APPLICATIONS

(75) Inventors: Craig D. Tipton, Perry, OH (US); Claire Hollingshurst, Heanor (GB); Elisa J. Seddon, Lyndhurst, OH (US); James P. Roski, Willowick, OH (US); Christopher Friend, Bobbers Mill (GB); Willis P. Nichols, Cleveland, OH (US); Betsy J. Butke, Mentor, OH (US); James J. Schwind, Chardon, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 761 days.

(21) Appl. No.: 12/532,902

(22) PCT Filed: Apr. 1, 2008

(86) PCT No.: PCT/US2008/058999

§ 371 (c)(1),
(2), (4) Date: Feb. 15, 2010

(87) PCT Pub. No.: WO2008/124386

PCT Pub. Date: Oct. 16, 2008

(65) Prior Publication Data

US 2010/0152080 A1 Jun. 17, 2010

Related U.S. Application Data

(60) Provisional application No. 60/910,065, filed on Apr. 4, 2007.

(51) Int. Cl.
*C07C 309/00* (2006.01)
*C07C 315/00* (2006.01)

(52) U.S. Cl.
USPC ..... 508/390; 568/32

(58) Field of Classification Search
CPC ..... C10M 2203/1006; C10M 2219/046; C10M 2215/28; C10M 2215/08
USPC ..... 508/390; 568/32
See application file for complete search history.

(56) References Cited

U.S. PATENT DOCUMENTS

| | | | | |
|---|---|---|---|---|
| 3,764,533 | A * | 10/1973 | Hunt et al. | 508/391 |
| 4,259,193 | A | 3/1981 | Tirtiaux et al. | |
| 5,344,967 | A | 9/1994 | Schnur et al. | |
| 6,372,696 | B1 * | 4/2002 | Tipton | 508/110 |
| 6,410,491 | B1 | 6/2002 | Harrison et al. | |
| 6,551,967 | B2 | 4/2003 | King et al. | |
| 2004/0005988 | A1 | 1/2004 | Watanabe et al. | |
| 2004/0102339 | A1 | 5/2004 | Aoyagi et al. | |
| 2004/0209787 | A1 | 10/2004 | Aoyagi et al. | |

FOREIGN PATENT DOCUMENTS

| | | |
|---|---|---|
| EP | 1384769 | 1/2004 |
| EP | 1845149 | 10/2007 |
| WO | 95/17489 | 6/1995 |
| WO | 96/16146 | 5/1996 |

OTHER PUBLICATIONS

Rohrbaugh, R.H., et al., "Molecular Shape and the Prediction of High-Performance Liquid Chromatographic Retention Indexes of Polycyclic Aromatic Hydrocarbons", Analytical Chemistry, vol. 59, pp. 1048-1054, Apr. 1987.

Kier, L.B., et al., "Molecular Connectivity in Chemistry and Drug Research", Medicinal Chemistry ed. deStevens, pp. 33-39 and 46-65, Academic Press, New York 1976.

English language Abstract of JP 2002-226883, Patent Abstracts of Japan.

* cited by examiner

*Primary Examiner* — Vishal Vasisth

(74) *Attorney, Agent, or Firm* — David M. Shold, Esq.; Michael F. Esposito, Esq.

(57) ABSTRACT

A lubricant composition comprising an oil of lubricating viscosity and an oil-soluble branched-chain hydrocarbyl-substituted arenesulfonic acid salt, wherein the arenesulfonic moiety has at least one hydrocarbyl substituent which is a highly branched group as defined by having a Chi(0)/Shadow XY ratio greater than about 0.180, exhibits good dynamic frictional performance.

8 Claims, No Drawings

HIGHLY BRANCHED SULFONATES FOR DRIVE-LINE APPLICATIONS

This application is a 371 of PCT/US08/58999, filed Apr. 1, 2008, which claims benefit of 60/910,065, filed Apr. 4, 2007.

BACKGROUND OF THE INVENTION

The present invention relates to detergents based on salts of alkyaryl sulfonic acids. The alkyl groups are highly branched, which provides superior performance in drive-line applications such as automatic transmission fluids.

In automatic transmission fluid applications, branched chain sulfonates, typically derived from polypropylene-alkylated benzenes, are widely used, as they tend to impart stable dynamic frictional properties to formulations in which they are incorporated. Less expensive and more readily available linear sulfonates, derived from polyethylene alkylates, tend to give dynamic friction values which are unacceptably low for most automatic transmission applications.

Much effort has gone into formulating lubricants for drive-line applications. U.S. Patent Application 2004/0102339, Aoyagi et al., May 27, 2004, discloses a method for improving the frictional properties of functional fluids, e.g. the brake and clutch capacity. The friction-modifying material is a polyalkenyl sulfonate or alkali or alkaline earth metal salt, derived from a mixture of polyalkylenes comprising greater than about 20 mole percent alkyl vinylidene and 1,1-dialkyl isomers. The material is useful in automatic transmissions. Examples: methyl vinylidene isomer and 1,1-dimethyl isomers. Preferred monoolefins include propylene, butylene, particularly isobutylene, 1-octene and 1-decene. Polyolefins include, among others, polybutene, including polyisobutene. The polyisobutene sulfonates provide high frictional properties, as measured by Komatsu micro-clutch friction test (friction coefficient)

U.S. Patent Application 2004/0209787, Aoyagi et al., Oct. 21, 2004, discloses a method of improving the brake and clutch capacity of a functional fluid, comprising adding a friction-modifying amount of a polyalkenyl sulfonate.

U.S. Pat. No. 6,551,967, King et al., Apr. 22, 2003 discloses low overbased alkylaryl sulfonates. The alkyl group is a C15-C21 branched chain alkyl group derived from a propylene oligomer. An alkylbenzene is prepared by reacting a propylene oligomer with benzene. The propylene oligomers have an average of about 15-21 carbon atoms and a low di-olefin content.

U.S. Pat. No. 6,410,491, Harrison et al., Jun. 25, 2002, discloses a polyalkenyl sulfonic acid composition derived from a mixture of polyalkenes comprising greater than 20 mole percent alkyl vinylidene and 1,1-dialkyl isomers. In a preferred embodiment, the polyalkene is polyisobutene.

PCT Application WO 95/17489, Watts et al., Jun. 23, 1995, discloses a method of increasing the static coefficient of friction of an oleaginous composition such as an ATF, by adding a product of an oil-soluble substituted or unsubstituted, saturated or unsaturated, branched hydrocarbyl group containing from about 12 to about 50 total carbon atoms; a linking group; and a nitrogen-containing polar group.

There are many other patents and patent applications which describe lubricant formulations suitable for automatic transmissions. One among these many is U.S. Application 2006-0172899, Tipton et al., Aug. 3, 2006.

It would be desirable to be able to select alkylated or hydrocarbyl-substituted aromatic materials for use in forming sulfonic acids, such that the drive-line fluid into which they may be included will have favorable and stable dynamic frictional properties. The present invention provides such materials.

SUMMARY OF THE INVENTION

The present invention provides a lubricant composition comprising (a) an oil of lubricating viscosity and (b) a branched-chain hydrocarbyl-substituted arenesulfonic acid salt, wherein the arenesulfonic moiety has at least one hydrocarbyl substituent which is a highly branched group as defined by having a Chi(0)/Shadow XY ratio greater than 0.175 or than 0.180, said salt being soluble in said oil.

The invention further provides a method for lubricating a driveline apparatus, that is, a mechanical power transmission device such as an automatic transmission of any of a variety of types (including continuously variable transmissions, dual clutch transmissions, traction drives), manual transmissions, and gear boxes, comprising supplying thereto a lubricant composition which comprises (a) an oil of lubricating viscosity and (b) a branched-chain hydrocarbyl-substituted arenesulfonic acid salt, wherein the arenesulfonic moiety has at least one hydrocarbyl substituent which is a highly branched group as defined by having a Chi(0)/Shadow XY ratio greater than about 0.165, said salt being soluble in said oil.

The invention also provides a method for preparing a branched-chain hydrocarbyl-substituted arenesulfonate, wherein the hydrocarbyl group is a highly branched group as defined by having a Chi(0)/Shadow XY ratio greater than 0.175 or 0.180, said method comprising (a) selecting a polyolefin or a substituted- or heteroatom interrupted-polyolefin corresponding to the desired hydrocarbyl substituent, having a Chi(0)/Shadow XY ratio greater than 0.175 or 0.180; (b) contacting said polyolefin or substituted- or heteroatom interrupted polyolefin with an aromatic compound such as toluene in the presence of a Lewis acid such as an aluminum halide, e.g., $AlBr_3$, at a temperature below 10° C. to form a hydrocarbyl-substituted intermediate; (c) contacting the hydrocarbyl-substituted intermediate with $SO_3$ or a source thereof to form a sulfonic acid; and (d) neutralizing said sulfonic acid.

DETAILED DESCRIPTION OF THE INVENTION

Various preferred features and embodiments will be described below by way of non-limiting illustration.

One component of the composition of the present invention is an oil of lubricating viscosity. The base oil used in the inventive lubricating oil composition may be selected from any of the base oils in Groups I-V as specified in the American Petroleum Institute (API) Base Oil Interchangeability Guidelines. The five base oil groups are as follows:

| Base Oil Category | Sulfur (%) | | Saturates (%) | Viscosity Index |
|---|---|---|---|---|
| Group I | >0.03 | and/or | <90 | 80 to 120 |
| Group II | <0.03 | and | >90 | 80 to 120 |
| Group III | <0.03 | and | >90 | >120 |
| Group IV | All polyalphaolefins (PAOs) | | | |
| Group V | All others not included in Groups I, II, III or IV | | | |

Groups I, II and III are mineral oil base stocks. The oil of lubricating viscosity, then, can include natural or synthetic lubricating oils and mixtures thereof. Mixture of mineral oil and synthetic oils, particularly polyalphaolefin oils and polyester oils, are often used.

Natural oils include animal oils and vegetable oils (e.g. castor oil, lard oil and other vegetable acid esters) as well as mineral lubricating oils such as liquid petroleum oils and solvent-treated or acid treated mineral lubricating oils of the paraffinic, naphthenic or mixed paraffinic-naphthenic types. Hydrotreated or hydrocracked oils are included within the scope of useful oils of lubricating viscosity.

Oils of lubricating viscosity derived from coal or shale are also useful. Synthetic lubricating oils include hydrocarbon oils and halosubstituted hydrocarbon oils such as polymerized and interpolymerized olefins and mixtures thereof, alkylbenzenes, polyphenyl, (e.g., biphenyls, terphenyls, and alkylated polyphenyls), alkylated diphenyl ethers and alkylated diphenyl sulfides and their derivatives, analogs and homologues thereof.

Alkylene oxide polymers and interpolymers and derivatives thereof, and those where terminal hydroxyl groups have been modified by, for example, esterification or etherification, constitute other classes of known synthetic lubricating oils that can be used.

Another suitable class of synthetic lubricating oils that can be used comprises the esters of dicarboxylic acids and those made from $C_5$ to $C_{12}$ monocarboxylic acids and polyols or polyol ethers.

Other synthetic lubricating oils include liquid esters of phosphorus-containing acids, polymeric tetrahydrofurans, silicon-based oils such as the polyalkyl-, polyaryl-, polyalkoxy-, or polyaryloxy-siloxane oils, and silicate oils.

Hydrotreated naphthenic oils are also known and can be used. Other oils include hydroisomerized waxes including oils prepared by a Fischer-Tropsch gas-to-liquid synthetic procedure.

Unrefined, refined and rerefined oils, either natural or synthetic (as well as mixtures of two or more of any of these) of the type disclosed hereinabove can used in the compositions of the present invention. Unrefined oils are those obtained directly from a natural or synthetic source without further purification treatment. Refined oils are similar to the unrefined oils except they have been further treated in one or more purification steps to improve one or more properties. Rerefined oils are obtained by processes similar to those used to obtain refined oils applied to refined oils which have been already used in service. Such rerefined oils often are additionally processed by techniques directed to removal of spent additives and oil breakdown products.

In certain embodiments of the present invention, the base oil is a synthetic oil such as a poly-alpha olefin such as a 4 centistoke poly-alpha olefin (i.e., having a nominal viscosity of 4 $mm^2$/sec at 100° C.). In certain embodiments, mixtures of synthetic and mineral base oils are used. In certain embodiments, at least 50, or at least 80, or at least 90 percent by weight of the oil of lubricating viscosity is a synthetic oil.

Another component of the present invention is a branched-chain hydrocarbyl-substituted arenesulfonic acid salt. Such salts are commonly referred to as detergents. The arenesulfonic acid salts are defined by having hydrocarbyl group with a Chi(0)/Shadow XY ratio greater than 0.175 or 0.180 or other appropriate values, as described below. The sulfonates may generally be prepared by a method comprising: (a) selecting a polyolefin or a substituted- or heteroatom interrupted-polyolefin corresponding to the desired hydrocarbyl substituent, having a Chi(0)/Shadow XY ratio greater than 0.175 or 0.180 or other value, as described below; (b) contacting said polyolefin or substituted- or heteroatom interrupted polyolefin with an aromatic compound such as toluene, benzene, or phenol, in the presence of a catalyst such a Lewis acid catalyst (including aluminum halides such as $AlCl_3$ or $AlBr_3$) at a temperature which is typically below 10° C. to form a hydrocarbyl-substituted aromatic intermediate; (c) contacting the hydrocarbyl-substituted intermediate with $SO_3$ or a source thereof to form a sulfonic acid; and (d) neutralizing said sulfonic acid. "Neutralizing" is intended to include overbasing, as described below, which may typically result in a product having measurable basicity. Thus the product need not be strictly neutral in terms of pH.

Detergents are typically overbased materials, otherwise referred to as overbased or superbased salts, which are generally single phase, homogeneous Newtonian systems characterized by a metal content in excess of that which would be present for neutralization according to the stoichiometry of the metal and the particular acidic organic compound reacted with the metal. The overbased materials are prepared by reacting an acidic material (typically an inorganic acid or lower carboxylic acid, preferably carbon dioxide) with a mixture comprising an acidic organic compound (in this instance, the branched-chain hydrocarbyl-substituted arenesulfonic acid), a reaction medium comprising at least one inert, organic solvent (mineral oil, naphtha, toluene, xylene, etc.) for said acidic organic material, a stoichiometric excess of a metal base, and a promoter such as a phenol or alcohol. The acidic organic material will normally have a sufficient number of carbon atoms to provide a degree of solubility in oil. The amount of excess metal is commonly expressed in terms of metal ratio. The term "metal ratio" is the ratio of the total equivalents of the metal to the equivalents of the acidic organic compound. A neutral metal salt has a metal ratio of one. A salt having 4.5 times as much metal as present in a normal salt will have metal excess of 3.5 equivalents, or a ratio of 4.5. The basicity of such detergents may also be expressed in terms of a total base number (TBN). A total base number is the amount of strong acid (perchloric or hydrochloric) needed to neutralize all of the overbased material's basicity. The amount of acid is expressed as potassium hydroxide units (mg KOH per gram of sample). The overbased materials may have a total base number of at least 20, or at least 100, or at least 200, up to 600, or to 500, or to 400 (typically measured on samples containing about 50% oil; on a neat basis the TBN will be correspondingly higher).

The metal portion of the detergent is typically an alkali or alkaline earth metal, such as sodium, calcium, potassium and magnesium. Typically, the detergents are overbased, meaning that there is a stoichiometric excess of metal over that needed to form the neutral metal salt. The excess metal from overbasing has the effect of neutralizing acids which may build up in the lubricant and also serves to increase the dynamic coefficient of friction. Typically, the excess metal will be present over that which is required to neutralize the anion at in the ratio of up to 30:1, or 5:1 to 18:1 on an equivalent basis.

In one embodiment, the branched chain hydrocarbyl-substituted arenesulfonic acid salt comprises a neutral or overbased calcium polyisobutene-substituted toluenesulfonate.

The resulting detergent may be post-treated by reacting with any of a variety of agents, such as boric acid or phosphorus acids. Borated and non-borated overbased detergents, including methods for their preparation, are well known and described in greater detail in many U.S. patents including U.S. Pat. Nos. 5,403,501 and 4,792,410. Other patents describing techniques for making basic salts of sulfonic acids and other acids include U.S. Pat. Nos. 2,501,731; 2,616,905; 2,616,911; 2,616,925; 2,777,874; 3,256,186; 3,384,585; 3,365,396; 3,320,162; 3,318,809; 3,488,284; and 3,629,109.

Whether or not the hydrocarbyl-substituted arenesulfonic acid is in the acid or neutralized form, for the purposes of the present invention it will be particularly selected on the basis of its hydrocarbyl substituent. In particular, the hydrocarbyl substituent will be branched-chain hydrocarbyl group with a high degree of branching as defined by having a Chi(0)/Shadow XY ratio of greater than 0.165, or in certain embodiments greater than 0.175 or greater than 0.180 or greater than 0.195.

These parameters may be derived from a mathematical model of molecular branching. The first such parameter employed in the model, Chi(0) (also written $\chi(0)$) refers to the Kier and Hall molecular connectivity index. The Chi index was originally defined by Randić in 1975 and subsequently refined by Kier and Hall in 1976. (For details refer to *Molecular Connectivity in Chemistry and Drug Research*, L. B. Keir and L. H. Hall, Academic Press, New York, 1976, Volume 14 of *Medicinal Chemistry*, series editor G. deStevens; see pages 33-39 and 46-65.) The Chi(0) index, in the context of the present invention, is a function of the number of "vertices" in a hydrocarbyl group. Each atom (other than hydrogen atoms) in the hydrocarbyl group is assigned a property δ, which is the number of its own electrons in sigma bonds to its skeletal neighbors, excluding sigma bonds to adjacent hydrogen atoms. Thus, $$\delta=\sigma-h$$

where σ is the total number of the atom's own electrons in sigma bonds and h is the number of hydrogen atoms bonded to the atoms. For this calculation, although each sigma bond will contain two electrons, only one electron is considered to be contributed by the atom in question (typically a carbon atom.) The connectivity weight, c, assigned to each vertex (that is, each non-hydrogen atom) is $c=\delta^{1/2}$. The Chi(0) value for a hydrocarbyl group, then, is the sum of all connectivity weights c for all non-hydrogen atoms in the group.

number of atoms $$\chi(0) = \sum_{i=1} c_i$$

The "shadow XY" value is a geometric descriptor characterizing the shape of the hydrocarbyl group. The molecular shape and lowest energy conformation of the corresponding hydrocarbon molecule is initially calculated. This may be done using a semi-empirical quantum mechanics program known as "MOPAC," which is utilized in the commercially available program "Chem3D" from CambridgeSoft Corporation, as well as similar programs from other suppliers such as Accelrys Software, Inc. For further reference, see J. E. Ridley, M. C. Zerner, *Theoret. Chim. Acta,* 42, 223, 1976; A. D. Bacon, M. C. Zerner, *Theoret. Chim. Acta,* 53, 21, 1979; M. C. Zerner, G. H. Loew, R. F. Kirchner, U. T. Mueller-Westerhoff, *J. Am. Chem. Soc.,* 102, 589, 1980. The molecular structure thus calculated is aligned so that its principal moment of inertia is defined as the X axis and its secondary moment of inertia is identified as the Y axis. Thereafter, the "shadow XY" is calculated by projecting the molecular surface of the group onto the XY plane. This is described in greater detail in Rohrbaugh and Jurs, *Anal. Chem.,* 1987, 59, 1048-1054. Shadow XY may be presented in units of $Å^2$ (square Angstroms). Other methods of calculation may be used, as will be evident to the person of skill in the art.

It has now been found that the ratio $\chi(0)$/shadow XY provides a useful quantitative description of the extent of branching of a hydrocarbon molecule, and, by extension, of the corresponding hydrocarbyl group. The ratio is also relatively independent of the length of the hydrocarbyl chain. Values of certain materials are presented in the following Table I:

TABLE I

| Alkyl chain | Chi(0) | Shadow XY | Chi(0)/Shadow XY |
|---|---|---|---|
| C20 polyethylene | 14.728 | 104.0 | 0.1416 |
| Branched polyethylene[a] | 45.188 | 311.7 | 0.1450 |
| C21 polypropylene | 16.414 | 103.3 | 0.1588 |
| C32 poly-1-butene | 24.355 | 144.0 | 0.1692 |
| C32 poly-2-butene | 25.497 | 135.2 | 0.1886 |
| C40 polyisobutene | 16.027 | 124.7 | 0.20087 |

[a]number average molecular weight about 868: average number of branches about 9; methyl branches, about 4; branches $C_4$ or above, about 4.

Moreover, it is possible to define a "branching index" parameter from the aforementioned ratio which bears a good intuitive relationship to the perceived degree or extensiveness of branching. The "branching index," BI, is defined herein as $$BI=60.283\times(\text{Chi}(0)/\text{Shadow } XY \text{ ratio})-8.453$$

Examples of calculated Chi(0)/Shadow XY ratios and "branching index" for hydrocarbyl groups derived from oligomerization of certain monomers are reported in Table II, below. Entries presented in italics have not been individually calculated but are estimated or interpolated based on surrounding or analogous entries.

TABLE II

| Monomer (# C atoms) | χ(o)/Shadow XY | Branching Index |
|---|---|---|
| ethylene (2) | 0.1416 | 0.08 |
| propylene (3) | 0.1588 | 1.12 |
| 1-butene (4) | 0.1691 | 1.74 |
| 2-butene | 0.1886 | 2.91 |
| isobutene | 0.2087 | 4.13 |
| *1-pentene* (5) | *0.17* (*est.*) | *2* |
| cyclopentene | 0.1877 | 2.86 |
| *2-pentene* | *0.19* (*est.*) | *3* |
| *3-methylbut-1-ene* | *0.20* (*est.*) | *3.6* |
| isoprene | 0.1981, 0.2207* | 3.49, 4.85 |
| 1-hexene (6) | 0.1733 | 1.99 |
| cyclohexene | 0.1842 | 2.65 |
| 2-hexene | 0.1929 | 3.18 |
| 3-hexene | 0.1902 | 3.01 |
| propylene dimer (4-methylpent-2-ene) | 0.2167 | 4.61 |
| *1-octene* (8) | *0.17* (*est.*) | *2* |
| *2-octene* | *0.19* (*est.*) | *3* |
| styrene | 0.2055 | 3.93 |
| 1-decene (10) | 0.1697 | 1.78 |

*Two values corresponding to polymerization through the 1, 2 double bond and the 3, 4 double bond, respectively.

In certain embodiments, the Chi(0)/Shadow XY ratio will be greater than 0.165 (or branching index greater than about 1.49), which will encompass oligomers from all the monomers listed in Table II except for ethylene and propylene. In other embodiments, the Chi(0)/Shadow XY ratio will be greater than 0.175 or 0.180 (or branching index greater than about 2.10 or 2.40, respectively), which will encompass oligomers from the monomers in Table II with a greater degree of branching than oligomers of 1-hexene or 1-pentene, for example. And in other embodiments, the Chi(0)/Shadow XY ratio will be greater than 0.195 (or branching index greater than about 3.30), which will encompass oligomers from isobutene, 3-methylbut-1-ene, isoprene, propylene dimer, and styrene, as well as oligomers (or polymers) of similar branching index.

Thus, the hydrocarbyl group may be a polyalkene group, and the polyalkene may in certain embodiments consist of polymer or oligomer of 2-butene, isobutene, cyclopentene, 2-pentene, 3-methylbut-1-ene, isoprene, cyclohexene, 2-hexene, 3-hexene, 4-methylpent-2-ene, 2-octene, or 3-octene.

The length of the hydrocarbyl group will be a length sufficient to impart oil solubility to the sulfonic acid salt. Solubility may be characterized as a mixture of 0.1 percent by weight of the salt in an API Group I oil, providing a visually clear composition, especially after standing for 1 week at room temperature. The length of the hydrocarbyl group necessary to provide such solubility may depend on the specific structure of the group, but generally the longer the hydrocarbyl group, the better will be the solubility. Typically, the salts of the present invention will have a hydrocarbyl group (exclusive of the arenesulfonic acid moiety) of at least 12 carbon atoms, or at least 16 or 18 or 20 or 30 or 35 or 40 carbon atoms. The upper limit on size of the hydrocarbyl group is not particularly critical, although for practical reasons various upper limits of 120 or 80 or 60 or 40 carbon atoms may be useful. In certain embodiments the number of carbon atoms in the hydrocarbyl group or groups will be such that the hydrocarbyl-substituted arenesulfonic acid salt overall has a number average molecular weight of at least 500 or 600 or 700 as measured by ASTM D 3712. Such molecular weights may correspond to approximately 24 or 30 or 40 carbon atoms in the hydrocarbyl groups.

The branched chain detergent described above will typically be used in a lubricant formulation in an amount to provide suitable detergency thereto. When it is used in an automatic transmission fluid, it will be used in an amount suitable to supply or improve stable dynamic frictional properties of the fluid. Typical amounts for such an application are 0.01 to 5 weight percent on an oil free basis, such as 0.025 to 3, or 0.05 to 3, or 0.1 to 1.0 percent (on an oil-free basis).

Other materials useful in automatic transmission lubricants include friction modifiers (in addition to those branched-chain hydrocarbyl-substituted arenesulfonic acid salts described above), such as secondary or tertiary amines. Such amines will contain at least two substituent hydrocarbyl groups, for example, alkyl groups. The amines may be represented by the formula $$R^1R^2NR^3$$

wherein $R^1$ and $R^2$ are each independently an alkyl group of at least 6 carbon atoms (e.g., 8 to 20 carbon atoms or 10 to 18 or 12 to 16) and $R^3$ is a hydroxyl-containing alkyl group, a hydroxyl-containing alkoxyalkyl group, an amine-containing alkyl group, a hydrocarbyl group, or hydrogen, provided that when $R^3$ is H, then at least one of $R^1$ and $R^2$ is an alkyl group of 8 to 16 carbon atoms such as, for instance, 10 to 16 carbon atoms or 12 to 14 carbon atoms.

Other friction modifiers include any of those described in U.S. Pat. No. 4,792,410. U.S. Pat. No. 5,110,488 discloses metal salts of fatty acids and especially zinc salts, which are also useful as friction modifiers. A list of other friction modifiers includes fatty phosphites, fatty acid amides, fatty epoxides, borated fatty epoxides, fatty amines, glycerol esters, borated glycerol esters, alkoxylated fatty amines, borated alkoxylated fatty amines, metal salts of fatty acids, sulfurized olefins, fatty imidazolines, condensation products of carboxylic acids and polyalkylene-polyamines, metal salts of alkyl salicylates, amine salts of alkylphosphoric acids, and mixtures thereof. Representatives of each of these types of friction modifiers are known and are commercially available. The amount of friction modifier in an automatic transmission fluid may be 0.01 to 10.0 percent by weight of the finished fluid formulation. Alternative amounts include 0.02 percent to 5 percent, or 0.1 percent to 3 percent, or 0.1 to 2 percent, or 0.5 to 1.5 percent.

Other materials which may be present include dispersants. Examples of carboxylic dispersants are described in many U.S. patents including the following: U.S. Pat. Nos. 3,219,666, 3,316,177, 3,340,281, 3,351,552, 3,381,022, 3,433,744, 3,444,170, 3,467,668, 3,501,405, 3,542,680, 3,576,743, 3,632,511, 4,234,435, Re 26,433, and U.S. Pat. No. 6,165,235 and EP 0355895. Succinimide dispersants, a species of carboxylic dispersants, are prepared by the reaction of a hydrocarbyl-substituted succinic anhydride (or reactive equivalent thereof, such as an acid, acid halide, or ester) with an amine, typically a poly(ethylene amine). The hydrocarbyl substituent group generally contains an average of at least 8, or 20, or 30, or 35 up to 350, or to 200, or to 100 carbon atoms.

"Mannich dispersants" are the reaction products of alkyl phenols in which the alkyl group contains at least 30 carbon atoms with aldehydes (especially formaldehyde) and amines (especially polyalkylene polyamines). The materials described in the following U.S. patents are illustrative: U.S. Pat. Nos. 3,036,003, 3,236,770, 3,414,347, 3,448,047, 3,461,172, 3,539,633, 3,586,629, 3,591,598, 3,634,515, 3,725,480, 3,726,882, and 3,980,569.

Post-treated dispersants may also be used. They are generally obtained by reacting carboxylic, amine or Mannich dispersants with reagents such as urea, thiourea, carbon disulfide, aldehydes, ketones, carboxylic acids, hydrocarbon-substituted succinic anhydrides, nitriles, epoxides, boron compounds such as boric acid (to give "borated dispersants"), phosphorus compounds such as phosphorus acids or anhydrides, or 2,5-dimercaptothiadiazole (DMTD). Mixtures of dispersants can also be used.

The amount of dispersant in the compositions of the present invention may be generally 0.3 to 10 percent by weight, or 0.5 to 7 percent or 1 to 5 percent of the final blended fluid formulation.

Another component which may be present is a viscosity modifier. Viscosity modifiers (VM) and dispersant viscosity modifiers (DVM) are well known. Examples of VMs and DVMs are polymethacrylates, polyacrylates, polyolefins, styrene-maleic ester copolymers, and similar polymeric substances including homopolymers, copolymers and graft copolymers.

Examples of commercially available VMs, DVMs and their chemical types include the following: polyisobutylenes (such as Indopol™ from BP Amoco or Parapol™ from ExxonMobil); Olefin copolymers (such as Lubrizol™ 7060, 7065, and 7067 from Lubrizol and Trilene™ CP-40 and CP-60 from Uniroyal); hydrogenated styrene-diene copolymers (such as Shellvis™ 40 and 50, from Shell and LZ® 7341, 7351, and 7441 from Lubrizol); Styrene/maleate copolymers, which are dispersant copolymers (such as LZ® 3702, 3715, and 3703 from Lubrizol); polymethacrylates, some of which have dispersant properties (such as those in the Acryloid™ and Viscoplex™ series from RohMax, the TLA™ series from Texaco, and LZ 7702™ and LZ 7720™ from Lubrizol); olefin-graft-polymethacrylate polymers (such as Viscoplex™ 2-500 and 2-600 from Rohm GmbH); and hydrogenated polyisoprene star polymers (such as Shellvis™ 200 and 260, from Shell). Recent summaries of viscosity modifiers can be found in U.S. Pat. Nos. 5,157,088, 5,256,752 and 5,395,539. The VMs and/or DVMs may be incorporated into the fully-formulated compositions at a level of up to 15% by weight, for instance, 1 to 12% or 3 to 10%.

The lubricant formulations may also include at least one phosphorus acid, phosphorus acid salt, phosphorus acid ester or derivative thereof including sulfur-containing analogs in the amount of 0.002-1.0 weight percent. The phosphorus acids, salts, esters or derivatives thereof include phosphoric acid, phosphorous acid, phosphorus acid esters or salts thereof, phosphites, phosphorus-containing amides, phosphorus-containing carboxylic acids or esters, phosphorus-containing ethers, and mixtures thereof.

In one embodiment, the phosphorus acid, ester or derivative can be an organic or inorganic phosphorus acid, phosphorus acid ester, phosphorus acid salt, or derivative thereof. The phosphorus acids include the phosphorous, phosphoric, phosphonic, phosphinic, and thiophosphoric acids including dithiophosphoric acid as well as the monothiophosphoric, thiophosphinic and thiophosphonic acids. One group of phosphorus compounds are alkylphosphoric acid mono alkyl primary amine salts as represented by the formula

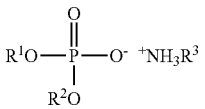

where $R^1$, $R^2$, $R^3$ are alkyl or hydrocarbyl groups or one of $R^1$ and $R^2$ can be H. The materials can be a 1:1 mixture of dialkyl and monoalkyl phosphoric acid esters. Compounds of this type are described in U.S. Pat. No. 5,354,484.

Eighty-five percent phosphoric acid may be a suitable material for addition to the fully-formulated compositions and can be included at a level of 0.01-0.3 weight percent based on the weight of the composition, or 0.03 to 0.2 or to 0.1 percent.

Other materials can optionally be included in the compositions of the present invention. Such materials include antioxidants (that is, oxidation inhibitors), including hindered phenolic antioxidants, secondary aromatic amine antioxidants such as dinonyldiphenylamine as well as such well-known variants as monononyldiphenylamine and diphenylamines with other alkyl substituents such as mono- or di-octyl, sulfurized phenolic antioxidants, oil-soluble copper compounds, phosphorus-containing antioxidants, and organic sulfides, disulfides, and polysulfides such as 2-hydroxyalkyl, alkyl thioethers or 1-t-dodecylthio-2-propanol or sulfurized 4-carbobutoxycyclohexene or other sulfurized olefins. Other optional components include seal swell compositions, such as isodecyl sulfolane or phthalate esters, which are designed to keep seals pliable. Also permissible are pour point depressants, such as alkylnaphthalenes, polymethacrylates, vinyl acetate/fumarate or /maleate copolymers, and styrene/maleate copolymers. Another material is an anti-wear agent such as zinc dialkyldithiophosphates. These optional materials are known to those skilled in the art, are generally commercially available, and are described in greater detail in published European Patent Application 761,805. Also included can be known materials such as corrosion inhibitors (e.g., tolyltriazole, dimercaptothiadiazoles), dyes, fluidizing agents, odor masking agents, and antifoam agents. Organic borate esters and organic borate salts can also be included.

The above components can be in the form of a fully-formulated lubricant or in the form of a concentrate within a smaller amount of lubricating oil. If they are present in a concentrate, their concentrations will generally be directly proportional to their concentrations in the more dilute form in the final blend.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include:

hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form a ring);

substituted hydrocarbon substituents, that is, substituents containing non-hydrocarbon groups which, in the context of this invention, do not alter the predominantly hydrocarbon nature of the substituent (e.g., halo (especially chloro and fluoro), hydroxy, alkoxy, mercapto, alkylmercapto, nitro, nitroso, and sulfoxy);

hetero substituents, that is, substituents which, while having a predominantly hydrocarbon character, in the context of this invention, contain other than carbon atoms in a ring or chain otherwise composed of carbon atoms, and encompass substituents as pyridyl, furyl, thienyl and imidazolyl. Heteroatoms include sulfur, oxygen, nitrogen. In general, no more than two, preferably no more than one, non-hydrocarbon substituent will be present for every ten carbon atoms in the hydrocarbyl group; typically, there will be no non-hydrocarbon substituents in the hydrocarbyl group.

It is known that some of the materials described above may interact in the final formulation, so that the components of the final formulation may be different from those that are initially added. For instance, metal ions (of, e.g., a detergent) can migrate to other acidic or anionic sites of other molecules. The products formed thereby, including the products formed upon employing the composition of the present invention in its intended use, may not be susceptible of easy description. Nevertheless, all such modifications and reaction products are included within the scope of the present invention; the present invention encompasses the composition prepared by admixing the components described above.

EXAMPLES

Example 1

Synthesis of Polyisobutene-Substituted Toluenesulfonate, Calcium Salt

To a 2 L 4-necked flask equipped with stirrer, condenser (with drying tube), thermowell and addition funnel, is charged 750 g toluene and 500 g polyisobutene (Glissopal 550™, $M_n$ about 593). The charge is cooled to 4° C. and added thereto, dropwise over 21 minutes, is a solution of 5.4 g $AlBr_3$ in 30 g toluene. After stirring for an additional 32 minutes at about 0° C., addition of further catalyst solution (5.46 g $AlBr_3$ in 30 g toluene) is begun. Soon after beginning the addition, an exothermic reaction is apparent, the temperature increasing to 6° C., and the system becoming sensitive to additional small increments of catalyst. Addition of the catalyst is completed over 1 hour 5 minutes and the mixture stirred for an additional 1 hour at about 0° C. The alkylated intermediate is neutralized by the addition of base (20 g $Ca(OH)_2$ and 5 mL $NH_4OH$), filtered and vacuum stripped to remove toluene, then isolated by filtering, addition of a small amount of base (3 g $Ca(OH)_2$) and further vacuum stripping. The residue, 468 g, is filtered using a filter aid to yield a slightly hazy yellow oil, intermediate 1a.

To a similar flask is charged 400 g of the above intermediate 1a and 200 g hexane solvent. The mixture is heated to 56° C. $SO_3$, 93.6 g, is charged to an evaporator, and thence to the flask via a subsurface tube, along with a 14 L/hr (0.5 $ft^3$/hr)

nitrogen flow, over a period of 3 hours 27 minutes, the temperature being 55-57° C. The mixture is stirred for an additional 1¼ hours. The liquids are decanted from 6 g solids and are stripped, first under nitrogen, then under vacuum, at elevated temperature, taking care to avoid excessive foaming. The residue is filtered using a filter aid to yield 465 g of a viscous dark product, intermediate 1b.

To a 1 L flask, equipped similarly as described above, is charged 207 g diluent oil, 36 g $Ca(OH)_2$, and 12.4 g ethanol. With stirring, there is added 2.35 g acetic acid in 12.4 g water. To the mixture is added 400 g of intermediate 1b, over 37 minutes. An exothermic reaction ensues, and the mixture is further heated and held at about 98° C. for 3 hours 20 minutes. The product is isolated by stripping, dilution with hexane, filtration with filter aid, repeated stripping, and further dilution with diluent oil at elevated temperature. Upon cooling to room temperature, the product mixture becomes a rubber-like material.

Example 2

Synthesis of poly-n-butene-substituted toluenesulfonate, Calcium Salt

To a 3 L flask equipped as above and with a dry ice-acetone condenser is charged 20 g filter aid, 2 g $H_3PO_4$, and 600 g hexane. The charge is cooled to −20° C. while charging $BF_3$ at about 6 L/hr (about 0.2 $ft^3$/hr). While maintaining $BF_3$ addition at about 1.7 L/hr, 1 butene is charged at 140 L/hr (5 $ft^3$/hr), −20° C. Addition is continued for 4½ hours. The mixture is held for ½ hour without cooling, then 40 mL 50% NaOH is added. The mixture is filtered with additional filter aid and vacuum stripped to yield intermediate 2a.

To a 2 L flask, equipped similarly as in Example 1, is charged 699 g toluene and 9.3 g $AlCl_3$. The charge is cooled to 4° C. and added thereto is HCl at about 3 L/hr (about 0.1 $ft^3$/hr) over 24 minutes. To the mixture (at −1° C.) is added 466 g of intermediate 2a, over a period of 1 hour, with additional cooling supplied. Stirring is continued for an additional 3 hours at 0° C. To this intermediate is added, over 15 minutes, 29 mL $NH_4OH$. The mixture is stirred for 2½ hours while warming to room temperature. The intermediate is isolated by filtration with a filter aid and toluene and vacuum stripping, to yield 572 g residue, intermediate 2b.

To a similar flask, 1 L, is charged 514 g of intermediate 2b and 257 g hexane. The mixture is heated to 56° C. $SO_3$, 96.9 g, is charged to an evaporator, and thence to the flask via a subsurface tube, along with a 14 L/hr (0.5 $ft^3$/hr) nitrogen flow, over a period of 3 hours 42 minutes. The mixture is stirred for an additional 1½ hours. The liquids are decanted and washed with hexane from 10 g solids and are thereafter stripped, first under nitrogen, then under vacuum, at elevated temperature. The residue is filtered using a filter aid to yield 558 g of intermediate 2c.

To a 1 L flask, equipped similarly as described above, is charged 155 g diluent oil, 19.9 g $Ca(OH)_2$, and 8.1 g ethanol. With stirring, there is added 1.39 g acetic acid in 8.16 g water. To the mixture is added 260 g of intermediate 2c, over 30 minutes. An exothermic reaction ensues, and the mixture is further heated and held at about 98° C. for 2 hours. The product is isolated by stripping, dilution with toluene, filtration with filter aid, and repeated stripping.

Examples 3-7

The detergents of Examples 1 and 2, as well as certain other detergents, are tested for their friction performance in an oil composition. The base oil employed is a mixture of two API Group II oils, 20% Texaco Motiva™ HVI 4 cSt oil and 80% Texaco Motiva™ HVI 3 cSt oil. (Designation of an oil of a certain cSt value refers to the nominal kinematic viscosity at 100° C., expressed in $mm^2$/s.) Each detergent is tested in the oil without other additives present and at a treat rate such that each blend contains 0.83 weight percent of the detergent substrate.

The friction coefficient performance is measured in an apparatus comprising a steel disk, 31.8 mm (1.25 inches) in diameter which has been coated with a test coating (for instance, a cellulose composition as used in automatic transmission clutches). The treated disk is rotated against an uncoated steel disk, immersed in test oil, at a defined temperature and applied pressure. The oil formulation to be tested is charged to the test cell and heated to 150° C. A one-hour break-in phase is conducted during which time the disk is rotated at 500 r.p.m. under a load of 25 kg (245 N). After the break-in period, the speed is increased to 1000 r.p.m., followed by deceleration to zero over 50 seconds, during which time the friction coefficient is measured and recorded. The test is repeated after the oil is allowed to cool to 100° C. and a second time at 40° C.

The test is run on both a sample of new (unaged) oil and a sample which has been aged by bubbling of oxygen through a 50 mL sample at 5 mL/min for 50 hours at 160° C. It is desired that the dynamic coefficient of friction should not decrease significantly after aging.

The results of testing of several hydrocarbylarenesulfonates are summarized in the Table 1. An approximately average coefficient of friction is reported for the range of 100 to 1000 r.p.m., with an indication of whether the coefficient generally increases with increasing r.p.m., decreases, or remains approximately constant over that range.

| Example | Detergent | T, ° C. | μ | slope |
|---|---|---|---|---|
| 3 (compar.) | Branched polyethylene-benzenesulfonate, Ca salt | 150 | 0.13 new<br>0.16 aged | constant,<br>sl. decrease |
| | | 100 | 0.14 new<br>0.15 aged | constant,<br>decrease |
| | | 40 | 0.15 new<br>0.15 aged | constant,<br>decrease |
| 4 (compar.) | Polypropylene benzenesulfonate, Ca salt | 150 | 0.16 new<br>0.16 aged | constant,<br>sl. decrease |
| | | 100 | 0.15 new<br>0.16 aged | sl. decrease,<br>sl. decrease |
| | | 40 | 0.14 new<br>0.15 aged | constant,<br>decrease |
| 5 | Poly-n-butene benzenesulfonate, Ca salt | 150 | 0.15 new<br>0.18 aged | constant,<br>decrease |
| | | 100 | 0.15 new<br>0.17 aged | constant<br>sl. decrease |
| | | 40 | 0.15 new<br>0.16 aged | constant<br>sl. decrease |
| 6 | Poly-n-butene toluenesulfonate, Ca salt (of Ex. 2) | 150 | 0.15 new<br>0.18 aged | constant,<br>decrease |
| | | 100 | 0.15 new<br>0.17 aged | constant,<br>sl. decrease |
| | | 40 | 0.15 new<br>0.16 aged | constant,<br>sl. decrease |
| 7 | Poly-iso-butene toluenesulfonate, Ca salt (of Ex. 1) | 150 | 0.17 new<br>0.19 aged | constant,<br>sl. decrease |
| | | 100 | 0.17 new<br>0.18 aged | constant,<br>sl. decrease |
| | | 40 | 0.16 new<br>0.17 aged | constant,<br>sl. decrease |

(note: sl. = "slight")

The results show that the formulations containing the more highly branched materials (examples 5-7) exhibit an unusually high dynamic friction after aging. It is quite unusual to be able to obtain dynamic coefficients of friction as high as 0.18 and 0.19 (150° C., aged) in such formulations. These results are very favorable because they indicate that the frictional performance of the fluid does not tend to deteriorate (decrease) with use, that is, it will maintain good and stable frictional performance.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil, which may be customarily present in the commercial material, unless otherwise indicated. It is to be understood that the upper and lower amount, range, and ratio limits set forth herein may be independently combined. Similarly, the ranges and amounts for each element of the invention can be used together with ranges or amounts for any of the other elements. As used herein, the expression "consisting essentially of" permits the inclusion of substances that do not materially affect the basic and novel characteristics of the composition under consideration.

What is claimed is:

1. A method for lubricating a driveline apparatus comprising supplying thereto a lubricant composition which comprises (a) a mineral oil of lubricating viscosity and (b) a branched-chain hydrocarbyl-substituted overbased calcium salt of benzenesulfonic acid or toluenesulfonic acid having a total base number (oil free) of about 40 to about 200 wherein the benzenesulfonic or toluenesulfonic moiety has at least one hydrocarbyl substituent of a polymer or oligomer of isobutene having 18 to about 80 carbon atoms, said salt being soluble in said oil.

2. The method of claim 1 wherein the branched chain hydrocarbyl-substituted benzenesulfonic acid or toluenesulfonic acid salt comprises an overbased calcium polyisobutene-substituted toluenesulfonate.

3. The method of claim 1 wherein the salt is soluble in the oil at a level of at least 0.1 percent by weight.

4. The method of claim 1 wherein the branched chain hydrocarbyl-substituted benzenesulfonic acid or toluenesulfonic acid salt has a number average molecular weight of at least about 500 as measured by ASTM D 3712.

5. The method of claim 1 wherein the lubricant further comprises at least one additive selected from the group consisting of viscosity index modifiers; phosphorus acids, salts, or esters; dispersants, and friction modifiers other than those of component (b).

6. The method of claim 1 wherein the driveline apparatus comprises an automatic transmission.

7. The method of claim 1 wherein the polymer or oligomer of isobutene contains up to about 60 carbon atoms.

8. The method of claim 1 wherein the polymer or oligomer of isobutene contains up to about 60 carbon atoms and the benzenesulfonic acid or toluenesulfonic acid salt comprises a substituted toluenesulfonate.

* * * * *